US005356018A

United States Patent [19]

Dubach

[11] Patent Number: 5,356,018

[45] Date of Patent: Oct. 18, 1994

[54] PLASTICS CLOSURE WITH WARRANTY ELEMENT

[75] Inventor: Werner F. Dubach, Maur, Switzerland

[73] Assignee: Createchnic AG, Switzerland

[21] Appl. No.: 941,084

[22] PCT Filed: Jan. 30, 1992

[86] PCT No.: PCT/CH92/00020

§ 371 Date: Oct. 13, 1992

§ 102(e) Date: Oct. 13, 1992

[87] PCT Pub. No.: WO92/13774

PCT Pub. Date: Aug. 20, 1992

[30] Foreign Application Priority Data

Feb. 12, 1991 [CH] Switzerland ..... 422/91-7

[51] Int. Cl.[5] ..... B65D 47/08

[52] U.S. Cl. ..... 215/237; 215/235; 215/253; 220/254; 220/265; 220/339; 222/541; 222/556

[58] Field of Search ..... 215/237, 235, 250, 253, 215/256, 274; 220/254, 256, 265, 276, 334, 339; 222/541, 545, 556, 562, 569

[56] References Cited

U.S. PATENT DOCUMENTS

| | | | |
|---|---|---|---|
| 1,626,381 | 4/1927 | Batts | 206/279 |
| 2,331,754 | 10/1943 | Wohlers | 229/39 |
| 4,085,842 | 4/1978 | Beck | 206/289 |
| 4,131,229 | 12/1978 | Nastasi | 229/39 |
| 4,318,472 | 3/1982 | Nauhemier et al. | 206/289 X |
| 4,334,639 | 6/1982 | Gach . | |
| 4,487,324 | 12/1984 | Ostrowsky . | |
| 4,696,408 | 9/1987 | Dubach . | |
| 4,722,449 | 2/1988 | Dubach | 215/235 |
| 4,782,964 | 11/1988 | Poore et al. | 215/216 |
| 4,795,044 | 1/1989 | Beck | 215/237 |
| 4,949,883 | 8/1990 | Dubach . | |
| 5,069,367 | 12/1991 | Salmon et al. | 222/153 |
| 5,083,671 | 1/1992 | Hayes | 215/245 |
| 5,094,361 | 3/1992 | Dubach . | |
| 5,115,931 | 5/1992 | Dubach . | |
| 5,141,138 | 8/1992 | Odet et al. | 222/541 |
| 5,147,054 | 9/1992 | Pehr | 215/253 |
| 5,221,017 | 6/1993 | Cistone et al. | 215/235 |

FOREIGN PATENT DOCUMENTS

| | | |
|---|---|---|
| 0141591 | 5/1985 | European Pat. Off. . |
| 3442152 | 6/1985 | Fed. Rep. of Germany . |
| 2633590 | 1/1990 | France . |
| 212300 | 7/1974 | Spain . |

*Primary Examiner*—Allan N. Shoap
*Assistant Examiner*—Vanessa Caretto
*Attorney, Agent, or Firm*—Speckman, Pauley & Fejer

[57] ABSTRACT

A plastic closure comprising a base part fixed on a container and a cap connected to said base part in one piece by a hinge. A gripping area is disposed diametrically opposite said hinge and is at least partially covered by a security element disposed on said base part. Securing means are provided on one part of said closure and on said security element, said securing means forming an interlocking connection prior to the first opening of the closure. The securing means comprise interlocking means disposed on the security element and directed toward the casing wall of the cap, which fit interlockingly with at least one corresponding recess in the cap aligned therewith.

5 Claims, 2 Drawing Sheets

PLASTICS CLOSURE WITH WARRANTY ELEMENT

BACKGROUND OF THE INVENTION

1. Field of the Invention

This invention relates to a plastic closure comprising a base part fixed on a container and a cap connected thereto in one piece by a hinge and a gripping area located diametrically opposite the hinge which is at least partially covered by a security element disposed on the base part, where, in addition, securing means are provided on one closure part and on the security element which are interlocked with each other prior to the first time the closure is opened.

DESCRIPTION OF THE PRIOR ART

A plastic closure of the above mentioned type is taught by Spanish reference ES-UM-212,300. An outwardly protruding hook is injection-molded on the base of the closure which, in the closed position of the closure, engages a hole in the cap. A security band injection-molded in the form of bars on the base prevents access, so that the securing means can only be pushed apart after it has been removed.

Another embodiment of security elements is shown in European Patent Application EP-A-0,141,591 in which a hook is disposed on the cap, which hook in the closed position extends below a security band which is injection-molded on the base at a distance from its cover surface in the form of bars, which are also used as predetermined breaking points. Also, a variant is shown where a plurality of outwardly extending protrusions are provided on the cap, instead of a hook, which extend below the described security band. However, completely identical solutions are also taught by U.S. Pat. No. 4,487,324 and German Patent application DE-A-34,42,152.

All of these closures have the unpleasant characteristic that outwardly protruding parts remain either on the cap or the base even after first opening and removal of the security band. This is not only ugly, but also unnecessary. In addition, these remaining hook-shaped protrusions constitute a latent danger of injury, because the user might scrape the skin on his fingers in the course of rapid opening or closing.

Another solution, where this problem does not occur, is taught by U.S. Pat. No. 4,696,408. Here the security element only forms a cover of the recess for the grip, so that the cap cannot be grasped. However, this constitutes only a partial solution to the problem because such a closure does have a security element, but no securing means. Accordingly, such a closure is not suitable for a container in which interior pressure can build up. Lacking securing means which positively lock the base and cap together, the closure can open because of accumulating gases or underpressure in its surroundings, for example during transport of beverages in bottles over mountains.

In addition, most security-protected closures can be opened by manipulation.

SUMMARY OF THE INVENTION

Accordingly, it is an object of this invention to provide a plastic closure having positively locked securing means where there is no danger of injury after removal of the security element and which is nevertheless safe from vandalism.

This object is attained by a plastic closure in accordance with this invention comprising a base part fixed on a container and a cap connected thereto in one piece by a hinge, said closure having a gripping area disposed diametrically opposite the hinge which is at least partially covered by a security element disposed on the base part. Securing means are provided on part of the closure and on the security element which interlock with each other prior to opening of the closure for the first time. The securing means comprise means disposed on the security element and directed towards the casing wall of the cap which fit interlockingly with corresponding recesses in the cap aligned therewith.

At least one securing means is directed towards the center of the closure and is attached to the security element, which form-fittingly engages a snap-in opening in the base of the closure. The protruding portions of the securing means are simultaneously removed along with the removal of the security element, which renders the danger of injury during subsequent operation of the closure impossible.

BRIEF DESCRIPTION OF THE DRAWINGS

Other features and advantages of this invention will be better understood from the following detailed description in conjunction with the exemplary embodiments of this invention shown in the drawings wherein.

DESCRIPTION OF PREFERRED EMBODIMENTS

Figure 1:
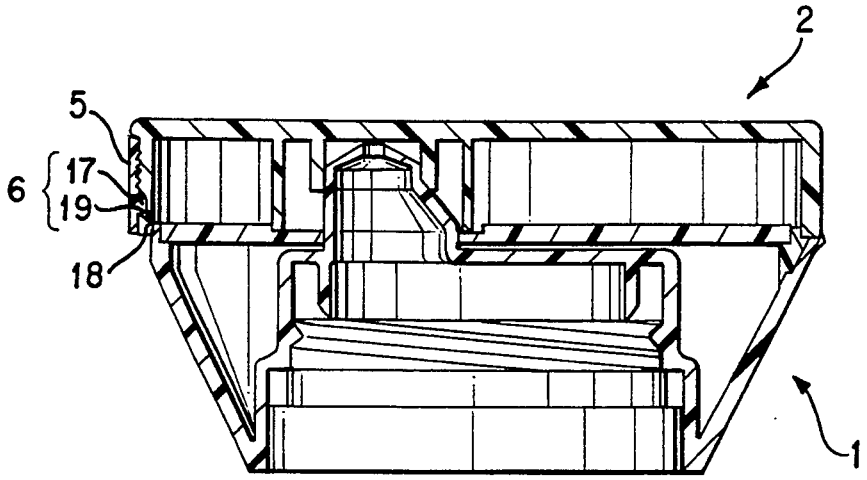
FIG. 1 shows an axial longitudinal cross-sectional view through a closure in accordance with one embodiment of this invention in the closed position, with the security element disposed thereon.
Figure 2:
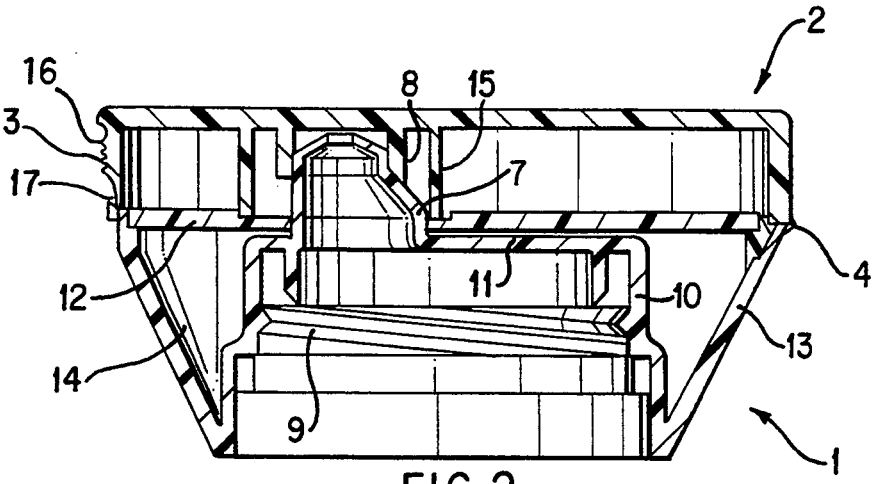
FIG. 2 is an axial longitudinal cross-sectional view of the closure shown in FIG. 1 with the security element removed.

Two embodiments of the subject of the invention are shown in the drawings on two differently designed plastic closures. The plastic closure in accordance with FIGS. 1 and 2 is designed for containers which hold a viscous medium. Such containers, for example ketchup containers, are normally inverted in their position of use. For this reason, the base 1 widens from the connection with the fastening means 9 for fastening on a container upwardly to the cap 2. The base 1 and cap 2 are connected to each other in one piece by a hinge 4. The design of the hinge 4 is unimportant for the purpose of this invention. Base 1 has an interior cylindrical part 10 which is closed by a cover area 11 in which a pouring spout 7 terminates. The lower rim of the cylindrical part 10 of the base 1 is transformed into casing wall 13, which conically widens from the bottom of base 1 towards the top extending above the cover area 11 of the cylindrical part 10. This results in an annular chamber 14 which can be closed by a cover surface 12 hinged in the area of the hinge 4.

The cap 2, connected to the base 1 by the hinge 4, has edge of the cover an annular wall 8 on its interior surface which forms clamping seal for the pouring 7 spout. The annular wall 8 is exactly aligned with the pouring spout 7. A second, concentric wall 15 is designed that it pushes against the cover surface 12 in the closed position of the closure. A recess is cut in the vertical wall diametrically opposite the hinge 4, forming the gripping area 3 and producing a rim formed by the top edge of the cover. To open the closure the user applies a force in gripping area 3 acting in the direction of opening with his thumb. To prevent slipping, the gripping area 3 is provided with a ribbing 16. In the lowermost part of the gripping area 3 an engagement recess 17 is provided, which has a rectangular cross section. Prior to the first opening of the closure by the user, a security element 5 is applied on the base 1 and the top edge of the cap covers the security element 5. The security element 5 is connected to the base 1 by a plurality of destructible connecting points 18. For example, the connecting points 18 can be embodied as bars used as predetermined breaking points. At the time of first closing, the cap 2 slides behind the security element 5 with its gripping area 3. The security element 5 has engagement hooks 19, which have a sawtooth-shaped cross section. Preferably a plurality of engagement hooks is provided, but a single engagement hook 19 is sufficient. In the secured position, the engagement hooks 19 engage the engagement recess 17 of the cap 2. The engagement recess 17 with the rectangular cross section, together with the engagement hooks 19, constitutes the securing means 6. The disconnection of these securing means 6, even by means of tools, is impossible without destroying the destructible connecting points 18 between the base 1 and the security element 5 at the same time.

In most cases, the security element 5 is designed as a security band which can be ripped off. However, it may be designed with thick walls so that it is given sufficient stiffness for being pushed off with a definite application of force. In any case, by its presence, the security element provides a visible check of intactness. As long as the security element is present, the securing means 6 cannot be disconnected. The engagement recess 17 does not pose an obstacle on which the user could injure himself. The protruding parts of the securing means, namely the engagement hooks 19, are removed simultaneously with the destruction of the connecting points 18. Thus, there is no possibility of injury by the engagement hooks 19.

A one-piece plastic closure with a snap hinge is shown in FIGS. 3 to 8. The reference numerals for like elements have been retained. The closure is shown in the position assembled on a container B. The container can be a deformable plastic bottle, for example. The closure illustrated here is more suited for thin-bodied media. Base 1 is connected to the cap 2 by a snap hinge 4. The main axis between the base 1 and the cap 2 is formed by a film hinge 20. An S-shaped spring element 21 causes the snap action of the closure. The spring element 21 is connected by a film hinge 22 to the base 1 and by a film hinge 23 to the cap 2. In accordance with this embodiment of the invention the base 1 has a cylindrical casing wall 24 and an inner annular wall 15. The inner annular wall 15 has a fastening means 9 for fastening on the container B. While in the embodiment of this invention shown in FIGS. 1 and 2 the fastening means was a screw thread, the fastening means comprises an annular groove in accordance with embodiment of the invention this which receives a suitable annular ring on the neck of the container. Such a closure can be simply pressed on. In turn, an annular wall 8 with a corresponding sealing ring is injection-molded on the cap itself. The annular wall 8, in turn, clampingly fits on the pouring spout 7, which extends through the cover area 11 of the base 1. The upper end of casing wall 24 extends at an angle from a lowest point located diametrically opposite the hinge 4 to a highest point located at the film hinge 20.

Figure 3:
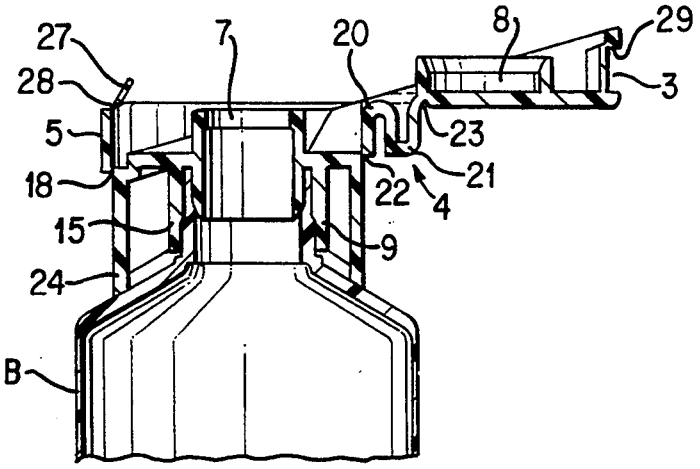
FIG. 3 is an axial longitudinal cross-sectional view of a closure with a security element in accordance with another embodiment of this invention prior to the first closing with the injection position in the completely opened position.
Figure 4:
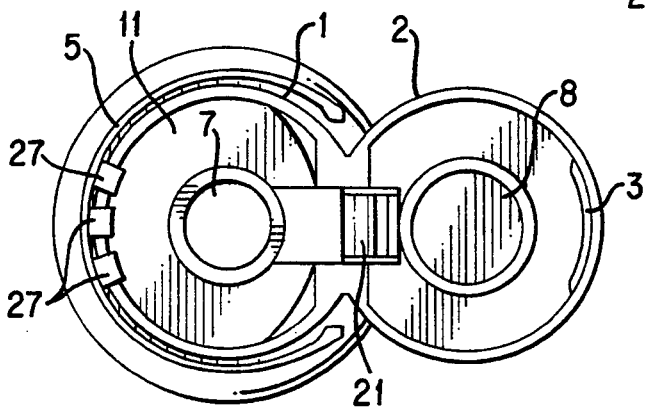
FIG. 4 is a top view of the closure shown in FIG. 3 in the installed position.

The closure is shown in FIGS. 3 and 4 in its manufacturing position, that is, in the position in which it is injection-molded. In this position, the security element 5 is still fixedly connected to the base 1 by destructible connecting points 18. A pivotable catch 27 which, in the manufacturing position is directed upwards at an angle, is disposed in the area of the upper edge of the security element 5. The pivotable catch 27 is latched by means of a film hinge 28 to the security element 5. When the closure is taken from the mold, the catch 27 can be pivoted away without problems so that there is no danger of this element being damaged at the time the closure is taken out of the mold. The pivotable catch 27 cooperates with a stop edge 29 which forms the lower limit of the gripping area 3. Alternately, three pivotable catches can be provided on the security element, as shown in FIG. 4.

Figure 5:
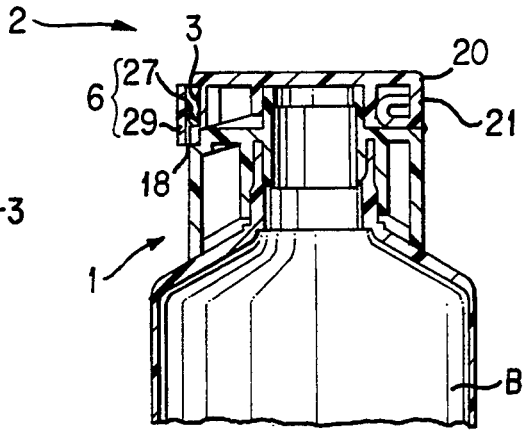
FIG. 5 is a longitudinal cross-sectional view of the closure shown in FIG. 3 in the closed position.
Figure 6:
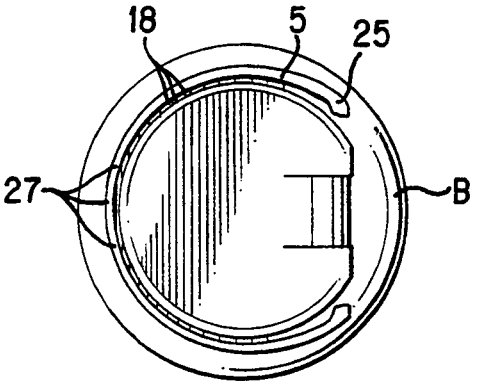
FIG. 6 is a top view of the closure shown in FIG. 5 in the closed position a top view.

FIGS. 4 and 5 show the plastic closure in accordance with one embodiment of this invention in the security position after the first closing. During the first closing, the lower edge of the cap 2 pushes the pivotable catch 27 downward and slides by it. The pivotable catch 27 is now located inside the gripping area 3 and rests on the stop edge 29. In turn, the pivotable catch 27, together with the stop edge 29, constitute the securing means 6. In this case, the security element is again shown as a security band which can be ripped off and which has gripping tongues 25 thickened at the ends. Again, the security element 5 constitutes a visual check of the intactness of the product. Even if an entry by means of a thin tool were made from above into the remaining narrow gap between the security element and the cap 2, the pivotable catch 27, because of its thickness, could not be pushed far enough towards the security element 5 so that it would no longer be caught by the stop edge 29. Thus, the security closure is absolutely safe against vandalism. The security band 5, which surrounds a large portion of the cap 2, does not make it possible to even grasp the cap 2. Thus, security is assured twice over.

Figure 7:
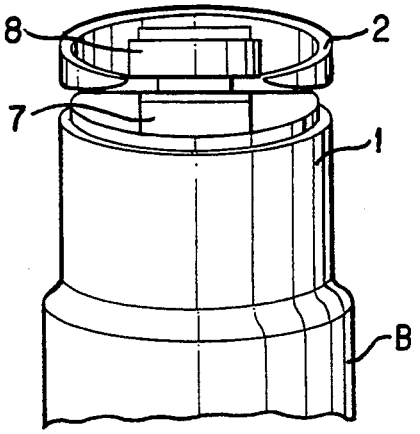
FIG. 7 shows a side view of the closure installed on a container in the open position, with the security element removed, 3
Figure 8:
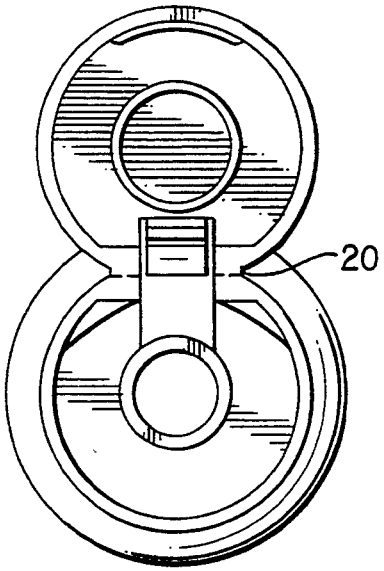
FIG. 8 shows a top view of the closure shown in FIG. 7 in an open position with the security element removed.

Once the security element 5 has been removed, as shown in FIGS. 7 and 8, the closure can be operated like a normal snap closure, without any protruding parts remaining on the base or cap, as a result of which any danger of injury is definitely avoided. Of course, here the security band need not be embodied simply as a security band, as shown, but again as a part which can be pushed off. Such a part would only be embodied somewhat larger than the gripping area 3. The destructible connection between the security element and the base can be embodied not only in the form of destructible bars, but also as a continuous thin area which can be ripped open.

It is astonishing that the simple idea to dispose the securing means 6 differently on the cap and the security element was not realized up to now. This is all the more astounding because by means of this it was possible for the first time to provide a really vandal-proof security closure. The security closures heretofore known could always be opened up to now with a little dexterity and a small screwdriver without destroying the security element or the connection between the security element and the base.

I claim:

1. In a plastic closure comprising a base part (1) fixed on a container (B) and a cap (2) connected to said base part (1) in one piece by a hinge (4), a gripping area (3) located diametrically opposite the hinge (4) at least partially covered by a security element (5) disposed on the base part (1), and securing means (6) on said cap (2) and on the security element (5), said securing means (6) in interlocking connection with each other prior to a first time the closure is opened, the improvement comprising: said securing means (6) comprising interlocking means (19, 27) disposed on the security element (5) and directed towards a casing wall of the cap (2) which fit interlockingly with at least one corresponding recess (17, 29) in the cap (2) aligned therewith, said gripping area (3) formed by a depression in said casing wall of the cap (2) wherein a top edge of said cap extends radially outwardly beyond at least a portion of said security element (5), and said at least one corresponding recess (17, 29) disposed within said gripping area (3) of the cap (2).

2. In a plastic closure in accordance with claim 1, wherein said securing means (6) comprises an engagement recess (17) on the cap (2), said engagement recess (17) having a rectangular cross section in longitudinal section, and at least one correspondingly designed engagement hook (19) on the security element (5).

3. In a plastic closure in accordance with claim 1, wherein in an area of an upper edge of the security element (5) at least one pivotable catch (27) is disposed, said pivotable catch (27) resting behind at least one stop edge (29) in the gripping area (3) prior to the first opening.

4. In a plastic closure in accordance with claim 3, wherein three pivotable catches (27) are provided, all of which rest behind the stop edge (29).

5. In a plastic closure in accordance with claim 3, wherein the pivotable catch (27) is connected to the security element (5) by a film hinge (28).

* * * * *